US007428817B2

(12) United States Patent
Brunner et al.

(10) Patent No.: US 7,428,817 B2
(45) Date of Patent: Sep. 30, 2008

(54) PREMIX BURNER WITH A SWIRL GENERATOR DELIMITING A CONICAL SWIRL SPACE AND HAVING SENSOR MONITORING

(75) Inventors: Philipp Brunner, Huntenschwil (CH); Jaan Hellat, Baden-Ruetihof (CH); Christian Oliver Paschereit, Berlin (DE)

(73) Assignee: Alstom Technology Ltd, Baden (CH)

( * ) Notice: Subject to any disclaimer, the term of this patent is extended or adjusted under 35 U.S.C. 154(b) by 203 days.

(21) Appl. No.: 11/502,468

(22) Filed: Aug. 11, 2006 (Under 37 CFR 1.47)

(65) Prior Publication Data

US 2007/0059655 A1 Mar. 15, 2007

Related U.S. Application Data

(63) Continuation of application No. PCT/EP2005/050529, filed on Feb. 8, 2005.

(30) Foreign Application Priority Data

Feb. 12, 2004 (CH) ..... 0211/04

(51) Int. Cl.
*F23R 3/12* (2006.01)

(52) U.S. Cl. ..... 60/737; 60/748; 60/803; 431/354

(58) Field of Classification Search ..... 60/737, 60/738, 748, 803; 431/354
See application file for complete search history.

(56) References Cited

U.S. PATENT DOCUMENTS 4,029,966 A 6/1977 Baker et al.
5,375,995 A * 12/1994 Dobbeling et al. ..... 60/737
5,586,878 A * 12/1996 Dobbeling et al. ..... 431/354
6,098,406 A * 8/2000 Bolis et al. ..... 60/737
6,142,665 A 11/2000 Haffner et al.
2002/0124549 A1 9/2002 Dittmann et al.

FOREIGN PATENT DOCUMENTS

| | | |
|---|---|---|
| EP | 0 210 462 | 3/1989 |
| EP | 0 321 809 B1 | 5/1991 |
| EP | 0 816 760 A1 | 1/1998 |
| EP | 0 972 987 A2 | 1/2000 |

* cited by examiner

*Primary Examiner*—Louis J Casaregola
(74) *Attorney, Agent, or Firm*—Buchanan Ingersoll & Rooney PC

(57) ABSTRACT

A premix burner is disclosed, with a swirl generator which delimits a conical swirl space and provides at least two conical part shells which are arranged, offset to one another, along a burner axis, mutually enclose in each case air inlet slits running longitudinally with respect to the burner axis and have in combination a conically widening premix burner outer contour having a maximum outside diameter which narrows axially into a region with a minimum outside diameter. At least one conical part shell provides, in the region between the maximum and the minimum outside diameter, a reception unit which deviates from the conically widening premix burner outer contour and locally elevates the premix burner outer contour radially outward and which has a maximum radial extent which is dimensioned smaller than half the maximum outside diameter of the premix burner outer contour. Within the reception unit, at least one hollow duct is provided, with at least one duct orifice facing away from the swirl space and with a duct longitudinal extent which runs essentially parallel to the burner axis.

20 Claims, 2 Drawing Sheets

PREMIX BURNER WITH A SWIRL GENERATOR DELIMITING A CONICAL SWIRL SPACE AND HAVING SENSOR MONITORING

RELATED APPLICATION

This application is based on and claims priority under 35 U.S.C. § 119 to Swiss Application No. 00211/04, filed Feb. 12, 2004 and is a continuation application under 35 U.S.C. § 120 of International Application No. PCT/EP2005/050529, filed Feb. 8, 2005 designating the U.S., the entire contents of both of which are hereby incorporated by reference.

BACKGROUND

A premix burner is disclosed with a swirl generator which delimits a conical swirl space and provides at least two conical part shells which are arranged, offset to one another, along a burner axis, mutually enclose in each case air inlet slits running longitudinally with respect to the burner axis and have in combination a conically widening premix burner outer contour having a maximum outside diameter which narrows axially into a region with a minimum outside diameter.

Premix burners of the generic type mentioned above are known from a multiplicity of publications with prior priority dates, such as, for example, from EP A1 0 210 462 and EP B1 0 321 809, to name only a few. Premix burners of this type are based on a general operative principle whereby, within a mostly conically designed swirl generator which provides at least two conical part shells assembled with a corresponding mutual overlap, a swirl flow is generated which consists of a fuel/air mixture and which is ignited within a combustion chamber following the premix burner in the flow direction, so as to form a premix flame which is as stable as possible in spatial terms.

Whether in a single or a multiple arrangement, premix burners of this type are used for the firing of combustion chambers in order to operate a thermal engine, in particular in gas or steam turbine plants, especially since these premix burners make it possible to use different fuels for forming a largely homogeneous fuel/air mixture which can ultimately be ignited so as to form an aerodynamically stabilized premix flame.

The operation of thermal power plants, in particular of gas turbine plants, has to satisfy high requirements in terms of their environmental compatibility, while the exhaust gases released into the atmosphere as a result of the combustion process are subject to strict emission limit values. Moreover, thermal power plants are to be optimized from the standpoint of their efficiency with which they are capable of converting energy into electrical energy, this applying as far as possible over the entire spectrum of their power range.

Present gas turbine plants are operated in a way known per se according to a permanently predetermined operating pattern which depends on a limited number of individually predetermined ambient conditions. Thus, such ambient conditions are, for example, the ambient temperature, the air humidity and also fuel qualities, to name only a few. The operating behavior of a gas turbine plant is influenced appreciably by these external influences. Thus, taking into account these and other ambient conditions, before the gas turbine plant, for example a predetermined construction series, is commissioned, what is known as an operating manual or "operating schedule" is drawn up, according to which important controlled variables are fixed which are to ensure as optimized an operation of the gas turbine plant as possible over the entire load range. The controlled variables relate particularly to quantitative and qualitative variables which regulate the supply of fuel and of combustion air to the burner unit.

Problems may arise, however, insofar as even the slightest manufacturing deviations are to be observed within a gas turbine series which relate particularly to the burner component. Since the premix burner of the type initially mentioned which is used in the burner has an optimized form of construction in terms of flame stability and emission behavior, even the slightest deviations in the premix burner design which impair the aerodynamic flow may have considerably adverse effects on the combustion result. If the combustion process is conducted in a way known per se by means of permanently predetermined controlled variables which cannot take into account the design deviations possibly occurring as a consequence of manufacture, this can lead to an unsatisfactory combustion result, which is ultimately reflected in the occurrence of overheatings in the burner or in the hot gas path lying downstream of the burner, in thermoacoustic oscillations, as they are known, and in impaired emission values. System-related aging phenomena in the individual components of the gas turbines can also contribute to impairing the operating behavior of the overall gas turbine plant as the age of the plant increases.

SUMMARY

Exemplary embodiments disclosed herein can monitor the overall combustion process actively and adapt the controlled variables, such as fuel supply and air supply, which influence the combustion process to the changes possibly occurring at that particular time. This presupposes a multiplicity of sensors detecting the operating behavior of the burner, with the result that the burner arrangement becomes arbitrarily complicated and ultimately cost-intensive in terms of production, although it is expedient to detect burner operating variables, such as fuel and air supply, flame temperature, the occurrence of thermoacoustic oscillations and surface temperatures, in order to obtain as complete a picture as possible of the current burner situation.

A premix burner is developed with a swirl generator which delimits a conical swirl space and provides at least two conical part shells which are arranged, offset to one another, along a burner axis, mutually enclose in each case air inlet slits running longitudinally with respect to the burner axis and have in combination a conically widening premix burner outer contour having a maximum outside diameter which narrows axially into a region with a minimum outside diameter, in such a way that the integration of differently designed sensor units into the housing of the premix burner is possible at as low an outlay as possible in structural terms. In particular, it is expedient to take measures on the premix burner whereby an adaption of the most diverse possible sensor units can be implemented easily and without a high outlay in servicing terms. The measures to be taken should likewise be capable of being carried out on premix burners which are already in use, so that there is the possibility of the retrofitability of suitably designed sensor units on premix burners which are in operation.

A premix burner can be configured such that at least one conical part shell provides, in the region between the maximum and the minimum outside diameter, a reception unit which deviates from the conically widening premix burner outer contour and locally elevates the premix burner outer contour radially outward and which has a maximum radial extent which is dimensioned smaller than half the maximum outside diameter of the premix burner outer contour. This configuration arises from the desire for compact construction, without the radial installation width of a premix burner in this case being impaired. Thus, in many instances, premix burners have in the axial direction a corresponding connection flange to a combustion chamber, at least the premix burner being surrounded by a housing enclosing a flow space in which the premix burner is supplied with incoming air. For maintenance reasons, the housing mostly has a correspondingly closable mounting orifice through which the premix burner can be mounted onto the combustion chamber housing axially. Owing to its compact external shape, the reception unit designed according to the invention in no way impairs the axial mountability of the premix burner and, moreover, offers the implementation of a sensor unit. For this purpose, the reception unit has at least one hollow duct with at least one duct orifice which faces away from the swirl space and via which the sensor unit can be implemented in the reception unit, the hollow duct having a duct longitudinal extent which runs essentially parallel to the burner axis. The duct longitudinal extent directed parallel to the burner axis allows the implementation of corresponding sensor units coaxially to the burner axis, with the result that even a premix burner equipped with corresponding sensor units has no components, the maximum radial extent of which projects beyond the maximum outside diameter of the premix burner housing, so that, even in this case, an axial mountability of the overall premix burner is maintained.

BRIEF DESCRIPTION OF THE DRAWINGS

The particular features of an exemplary premix burner arrangement are further dealt with in detail with reference to the exemplary embodiments.

The invention is described below by way of example, without restriction, by way of exemplary embodiments, with reference to the drawings in which.

DETAILED DESCRIPTION

Figure 1:
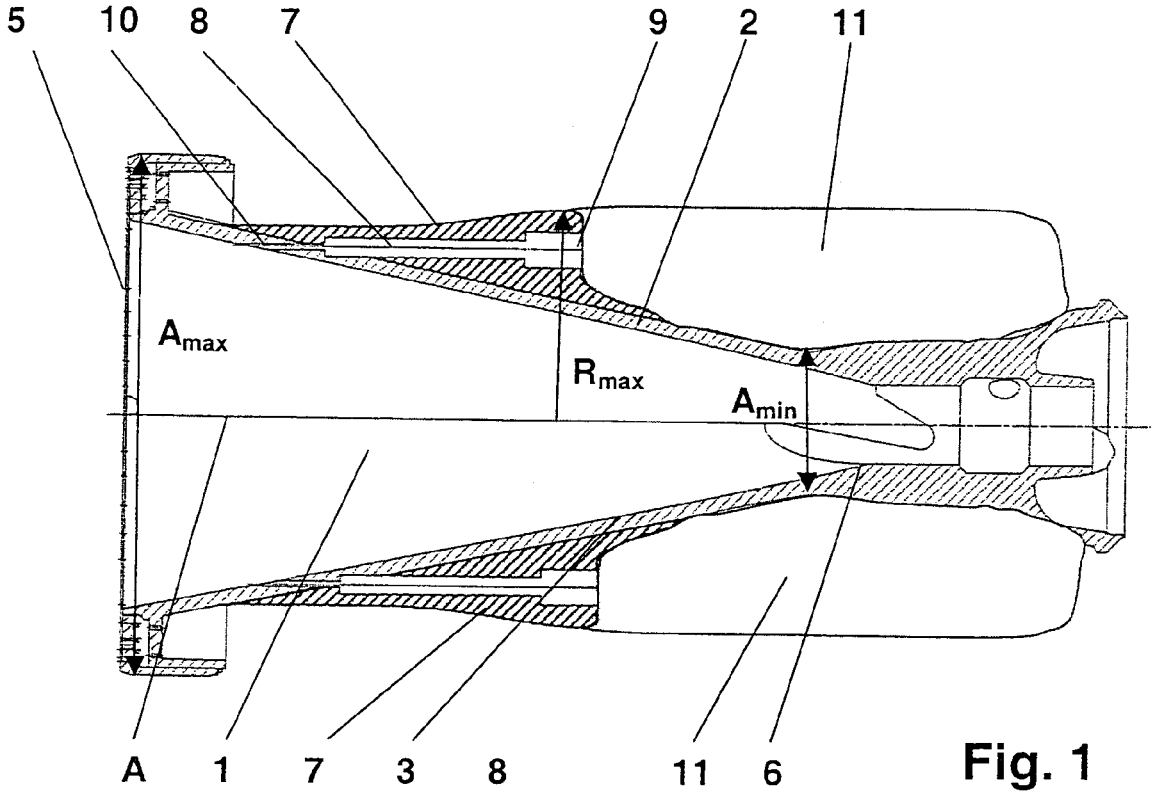
FIG. 1 shows a diagrammatic illustration of a longitudinal section through an exemplary premix burner.
Figure 2:
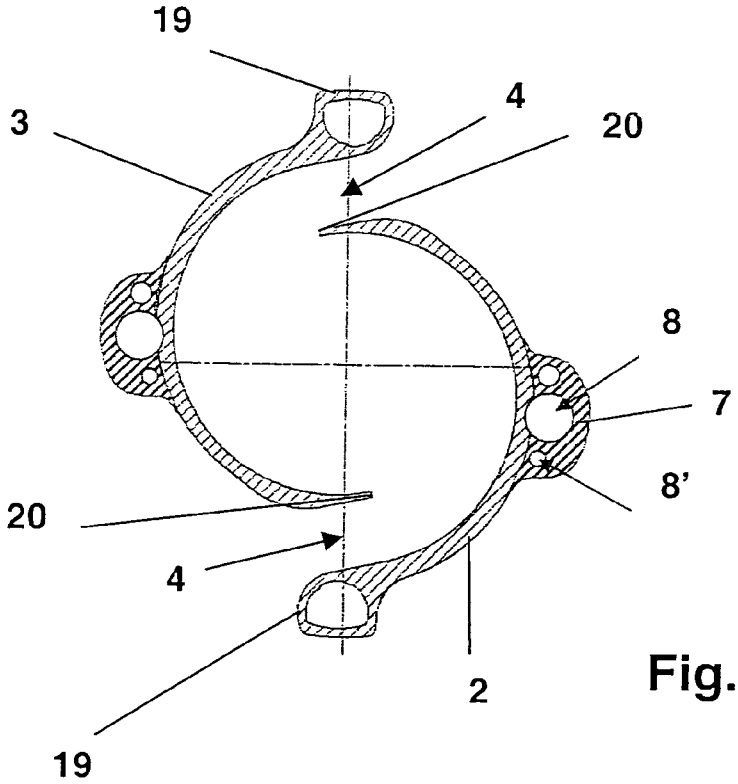
FIG. 2 shows a cross-sectional illustration through an exemplary premix burner.

FIG. 1 illustrates a longitudinal sectional illustration through a premix burner designed according to an exemplary embodiment of the invention, which has a conically designed swirl space 1 delimited by two conical part shells 2, 3. The conical part shells 2, 3 are arranged so as to be offset with respect to a burner axis A (see in this case the cross-sectional illustration according to FIG. 2) and mutually enclose in each case air inlet slits 4. Furthermore, the two conical part shells 2, 3 have a premix burner outer contour which at the location of the burner outlet 5 has a maximum outside diameter $A_{max}$ which narrows axially and provides a region 6 with a minimum outside diameter $A_{min}$ in which a central burner nozzle arrangement (not illustrated) can usually be positioned. In the exemplary embodiment illustrated in FIGS. 1 and 2, a reception unit 7 is provided in each case for each conical part shell 2, 3 and is joined firmly to the outer wall of the respective conical part shells 2, 3. The reception unit 7 has a maximum radial extent $R_{max}$ which is smaller or markedly smaller than half the maximum outside diameter $A_{max}$. This ensures that the premix burner unit can be lead, unimpeded, axially through mounting orifices which have only an insignificantly larger mounting diameter than the maximum outside diameter $A_{max}$. The reception unit 7 according to the exemplary embodiment in FIGS. 1 and 2 is designed as a separate component which can be joined in the form of a retrofit kit to the outer wall of the respective conical part shell 2, 3. It is, of course, possible to connect the reception unit 7 in one piece to the conical part shell during the production of the latter.

For the purpose of mechanical stabilization and also for protection against damage due to mounting work, supporting flanks 11 are attached to the outer housing of the premix burner and likewise do not project beyond the maximum outside diameter $A_{max}$.

Figure 3:
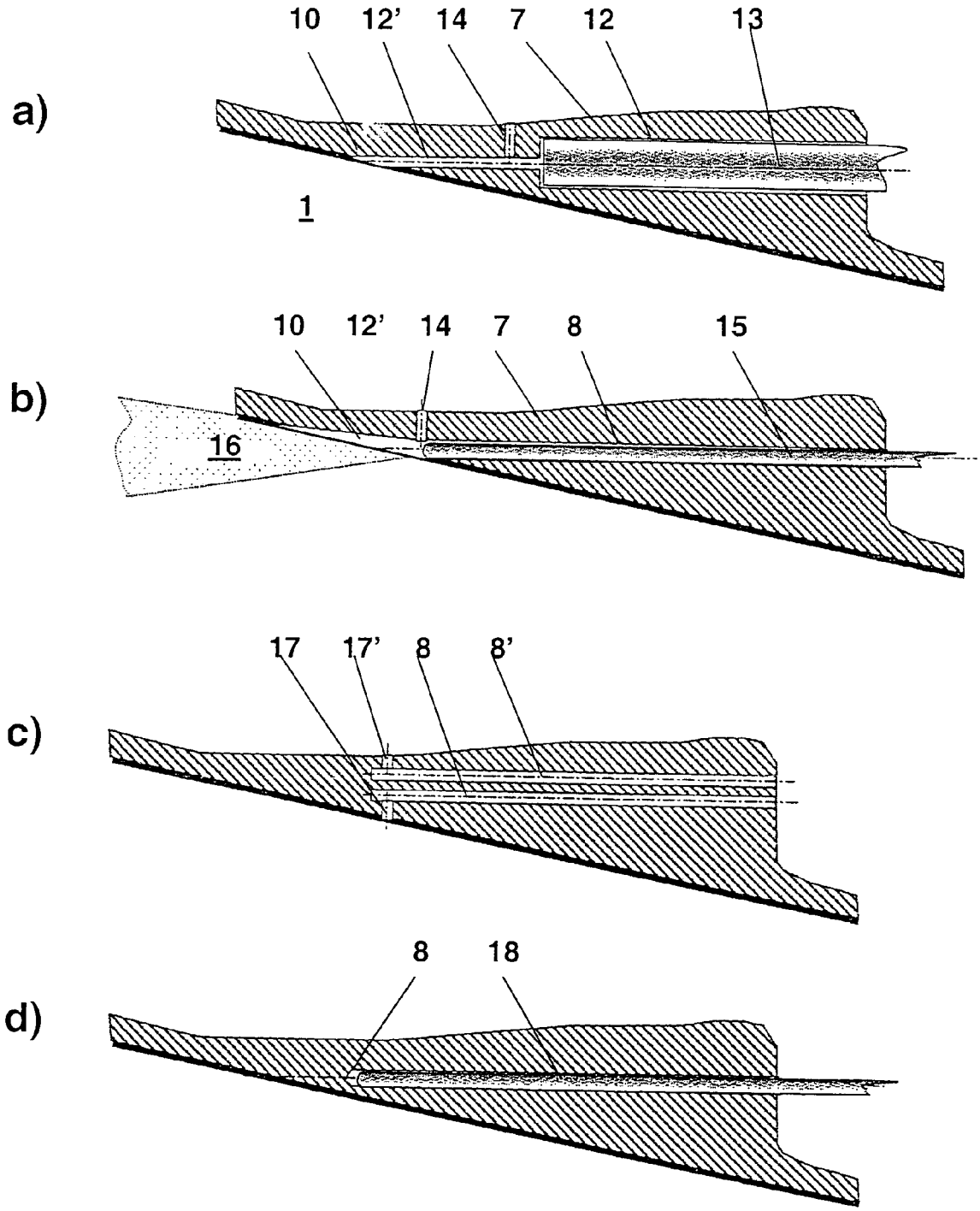
FIGS. 3*a* to 3*d* show a longitudinal section in each case through an exemplary reception unit, with different hollow ducts for the reception of different sensor units.

To implement a suitably designed sensor unit, the reception unit 7 has at least one hollow duct 8, the duct longitudinal extent of which is oriented parallel to the burner axis A. The hollow duct 8 has, moreover, in the exemplary embodiment illustrated in FIG. 1, a first duct orifice 9 which is open axially outward and allows the possibility of an axially directed push-in of a correspondingly designed sensor unit adapted in bar form to the inner contour of the hollow duct 8. Depending on the type of sensor unit, the inner contour of the hollow duct 8 may be designed in any desired way. In the exemplary embodiment illustrated, the hollow duct 8 issues directly into the swirl space 1 via a second duct orifice 10. With further reference to the exemplary embodiments according to FIG. 3, it becomes clear that the hollow duct 8 may have different inner contours, depending on the type of sensor used. What is common to all the hollow duct designs, however, is that they have an orientation which is coparallel to the burner axis A and allows axially directed equipping with corresponding sensor units.

As already mentioned, FIG. 2 shows a cross-sectional illustration through the premix burner illustrated in FIG. 1. It may be gathered from the cross-sectional illustration that the reception unit 7 has passing through it not only the hollow duct 8 designed as a main duct, but also in each case two further hollow ducts 8' into which corresponding sensor units can likewise be introduced. Moreover, it is particularly advantageous to arrange the reception unit 7 as centrally as possible, on the top side, facing away from the swirl space 1, of the conical part shell 2, 3, between the fuel supply pipe 19 and the shell end edge 20 in the circumferential direction, in order as far as possible not to influence the air stream directed into the air inlet slits 4. It has proved particularly advantageous to select the distance between the reception unit 7 and the shell end edge 20 exactly double the maximum radial elevation of the reception unit 7 above the top side of the conical part shell. Of course, furthermore, the surface contour of the reception unit 7 should have as streamlined a configuration as possible.

The longitudinal sectional illustration according to FIG. 3*a* to *d* show alternative embodiments of differently designed hollow ducts which are adapted in each case for different sensor types.

FIG. 3*a* has a hollow duct 8 which provides essentially two duct portions 12 and 12' having differently dimensioned diameters, the duct portion 12 of larger cross-sectional dimensioning being suitable preferably for the use of a microphone sensor 13. The duct portion 12 issues directly, via a duct portion 12' dimensioned with a smaller diameter, into the swirl space 1, by which, for example, pressure fluctuations can be transmitted, such as are initiated in the inner space of the combustion chamber due to the formation of thermoacoustic oscillations. In addition, the reception unit 7 provides a scavenging duct 14 via which cooling air can be fed into the hollow duct 8 in order to avoid the overheating of the microphone sensor unit 13. If cooling air is introduced under pressure through the scavenging duct 14 from outside into the hollow duct 8 in the region of the duct portion 12' the cooling air prevents the ingress of hot gases into the hollow duct 8 through the duct orifice 10 and thereby serves for preventing the overheating of the sensor unit.

In the exemplary embodiment according to FIG. 3*b,* the hollow duct 8 is designed with a constant inside diameter for the introduction of an optical flame sensor 15. The optical flame sensor 15 has an observation angle range 16 which is delimited, on the one hand, by the exit aperture of the optical flame sensor 15 and, on the other hand, by the duct orifice 10 enlarging the viewing angle. Again, to avoid an overheating of the flame sensor 15, a scavenging duct 14 serves for the supply of corresponding cooling air. The scavenging duct 14 is in this case provided in the immediate vicinity of the duct orifice 10, in order effectively to protect the front aperture region of the flame sensor 15 against thermal contact with the hot gases. With the aid of the optical flame sensor 15, the flame front forming within the combustion chamber can be monitored, the spatial position of said flame front being an important indication of stable combustion.

FIG. 3*c* has a double duct routing 8, 8', the hollow ducts 8, 8' designed as blind holes running parallel to the burner axis A. Moreover, both hollow ducts 8, 8' have duct portions 17, 17' running perpendicularly to the burner axis, the duct portion 17 issuing into the swell space 1 and the duct portion 17' issuing into the atmosphere surrounding the premix burner. With the aid of the hollow duct design illustrated in FIG. 3*c,* it is possible to carry out a differential pressure measurement. The differential pressure measurement serves essentially for determining the air throughflow through the burner. Consequently, it is possible to determine nonuniformities of the air distribution within the gas turbine housing and/or nonuniformities of the throughflow characteristic from burner to burner, insofar as there is a multiple burner arrangement. If differential pressure measurements are carried out on a plurality of conical shells of a burner, the nonuniformity of the air flow within a single burner can also be determined.

Finally, the exemplary embodiment according to FIG. 3*d* shows a hollow duct 8 which is designed as a complete blind hole and into which a thermosensor unit 18 can be introduced.

Of course, the sensor units described in the above exemplary embodiments can be combined in any desired way within a single reception unit 7, so that as high a multiplicity of different measurement data as possible can be obtained from the premix burner.

Thus, the sum of the above-described sensor units makes it possible to detect a multiplicity of operating variables, such as, for example, the flame temperature or the premix burner temperature within the conical part shells in order to determine the current load on the premix burner, so that, if appropriate, if overheatings are detected, corresponding cooling measures can be initiated.

It is also possible to carry out differential pressure measurements along the burner delivery lines, with the result that controlled monitoring and setting of the fuel supply, particularly in the case of a staged fuel supply, become possible. The flame temperature and the nitrogen oxide emission can thereby be influenced directly. With the aid of suitably designed optical sensors, the flame temperature, particularly in the premix flame forming within the backflow zone, can be determined. Likewise, the combustion quality can be monitored and correspondingly determined optically. With the aid of suitable pressure-sensitive sensors, such as, for example, microphone sensors, moreover, it is possible to detect thermoacoustic oscillations or pulsations which arise. With the aid of the measurement data obtained in the above way, active readjustment of the combustion process with a view to as optimized a combustion as possible can be carried out. With the aid of the design solution according to an exemplary embodiment, which, as stated, may also be carried out within the framework of a retrofit on already existing premix burners, it is possible to readjust the burner behavior to burner conditions currently occurring and influencing the burner process.

It is particularly advantageous, in the case of a multiple burner arrangement, to arrange the measurement sensor units in a plurality of burners. It is thereby possible to determine local distributions of pulsations, flame temperatures, pressure distributions, etc., and consequently the local distribution of the combustion quality can be deduced, so that, ultimately, the local burner conditions can also be readjusted.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 swirl space
2, 3 conical part shells
4 air inlet slits
5 burner outlet
6 region with minimum outside diameter
7 reception unit
8 hollow duct
9, 10 duct orifice
11 supporting flank
12, 12' hollow duct portions
13 microphone sensor
14 scavenging duct
15 optical flame sensor
16 see angle range
17, 17' second duct portion
18 thermosensor
19 fuel supply pipe
20 shell end edge

The invention claimed is:

1. A premix burner comprising:

a swirl generator which delimits a conical swirl space and provides at least two conical part shells which are arranged, offset to one another, along a burner axis (A), mutually enclose in each case air inlet slits running longitudinally with respect to the burner axis (A) and have in combination a conically widening premix burner outer contour having a maximum outside diameter ($A_{max}$) which narrows axially into a region with a minimum outside diameter ($A_{min}$);

wherein at least one conical part shell provides, in a region between a maximum and a minimum outside diameter, a reception unit which deviates from a conically widening premix burner outer contour and locally elevates the premix burner outer contour radially outward and which has a maximum radial extent ($R_{max}$) which is dimensioned smaller than half a maximum outside diameter ($A_{max}$) of the premix burner outer contour; and wherein, within the reception unit, at least one hollow duct is provided, with at least one duct orifice facing away from the swirl space and with a duct longitudinal extent which runs essentially parallel to the burner axis (A).

2. The premix burner as claimed in claim 1, wherein the hollow duct is configured as a blind hole.

3. The premix burner as claimed in claim 1, wherein the hollow duct is configured as a through duct which passes completely through the reception unit and the conical part shell and provides a duct orifice facing the swirl space.

4. The premix burner as claimed in claim 1, wherein the reception unit is joined firmly to a top side, facing away from the swirl space, of the conical part shell or is connected in one piece to the latter.

5. The premix burner as claimed in claim 1, wherein the hollow duct is configured rectilinearly, with at least one duct portion which has a constant duct cross section.

6. The premix burner as claimed in claim 3, wherein the hollow duct has at least two duct portions with a different duct cross section in each case, and wherein the duct portion with the smaller duct cross section adjoins the swirl space via the duct orifice facing the swirl space.

7. The premix burner as claimed in claim 3, wherein the duct orifice facing the swirl space has an orifice contour which arises due to a rectilinear passage of the hollow duct, which runs parallel to the burner axis (A), through the conical part shell.

8. The premix burner as claimed in claim 7, wherein the duct orifice facing the swirl space has an enlarged orifice contour, as compared with the orifice contour due to passage.

9. The premix burner as claimed in claim 3, wherein the hollow duct configured as a through duct has a first duct portion which runs essentially parallel to the burner axis (A) and is configured as a blind hole duct, and wherein there follows along the first duct portion a second duct portion which is oriented perpendicularly to the burner axis (A) and has the duct orifice facing the swirl space.

10. The premix burner as claimed in claim 9, wherein at least one second hollow duct configured as a through duct has a first duct portion which runs essentially parallel to the burner axis and is configured as a blind hole duct, and wherein there follows, along the first duct portion of the second hollow duct configured as a through duct, a second duct portion which is oriented perpendicularly to the burner axis (A) and has a duct orifice facing away from the swirl space.

11. The premix burner as claimed in claim 3, wherein the duct orifice facing the swirl space is arranged in the region of about one third of the burner length, measured from the burner outlet, that is to say the burner region with the maximum outside diameter ($A_{max}$).

12. The premix burner as claimed in claim 1, wherein the size, shape and arrangement of the at least one hollow duct are selected such that an axially directed equipping of the hollow duct with a sensor unit adapted in bar form to the inner contour of the hollow duct is possible.

13. The premix burner as claimed in claim 12, wherein the sensor unit is configured as an acoustic, optical, chemical, thermal or pressure sensor.

14. The premix burner as claimed in claim 12, wherein the hollow duct has, for a releasably firm attachment of the sensor unit to or in the hollow duct, a fastening device.

15. The premix burner as claimed in claim 4, wherein the top side, facing away from the swirl space, of the conical part shell is delimited in the circumferential direction, on the one hand, by a fuel supply pipe and, on the other hand, by a shell end edge, and wherein the reception unit is arranged centrally between the fuel supply pipe and the shell end edge.

16. The premix burner as claimed in claim 15, wherein, between the fuel supply pipe and the shell end edge, a distance is provided which corresponds at least to double the radial elevation of the reception unit with respect to the top side, facing away from the swirl space, of the conical part shell.

17. The premix burner as claimed in claim 15, wherein the reception unit has a streamlined surface contour which faces away from the conical part shell and by which an air stream issuing into the respective air inlet slits remains virtually uninfluenced.

18. The premix burner as claimed in claim 1, wherein the hollow duct is connected to at least one scavenging duct which projects radially outward through the conical part shell to feed a scavenging gas into the hollow duct.

19. The premix burner as claimed in claim 14, wherein the fastener is a screw connection, a connecting flange or a press fit.

20. The premix burner as claimed in claim 18, wherein the scavenging gas is cooling air.

* * * * *